United States Patent [19]

Cyphert

[11] 4,216,563

[45] Aug. 12, 1980

[54] COMBINED DRY AND WET CARPET CLEANER

[75] Inventor: Gilbert G. Cyphert, Glendale, Ariz.

[73] Assignee: Chemko Industries, Inc., Phoenix, Ariz.

[21] Appl. No.: 27,789

[22] Filed: Apr. 6, 1979

[51] Int. Cl.[3] ..... A47L 7/00

[52] U.S. Cl. ..... 15/321; 15/328; 15/353

[58] Field of Search ..... 15/320, 321, 328, 352, 15/353

[56] References Cited

U.S. PATENT DOCUMENTS

| | | | |
|---|---|---|---|
| 2,639,005 | 5/1953 | Gerstmann | 15/353 X |
| 2,844,840 | 7/1958 | Gray | 15/321 |
| 3,029,461 | 4/1962 | Osborn | 15/353 X |
| 3,180,071 | 4/1965 | Nolte | 15/328 |
| 3,262,146 | 7/1966 | Hays | 15/321 |
| 3,828,390 | 8/1974 | Cater | 15/321 |
| 3,866,541 | 2/1975 | O'Connor et al. | 15/320 X |
| 4,138,760 | 2/1979 | Cadle | 15/328 X |
| 4,151,627 | 5/1979 | Wisdom | 15/321 |

FOREIGN PATENT DOCUMENTS

| | | | |
|---|---|---|---|
| 692663 | 8/1964 | Canada | 15/328 |
| 1286204 | 1/1962 | France | 15/328 |

*Primary Examiner*—Christopher K. Moore

*Attorney, Agent, or Firm*—Cahill, Sutton & Thomas

[57] ABSTRACT

A base unit having a vacuum hose and vacuum head attachable thereto includes means for developing a source of low pressure. A detachably attachable housing supporting a conventional vacuum bag is mountable upon the base unit in fluid communication with the low pressure source to form, with the base unit, a dry or vacuum carpet cleaner. The housing is readily replaceable with a first container for ejecting a cleaning solution through jets in the vacuum head into the carpet being cleaned and with a second container in fluid communication with the low pressure source to draw and collect the cleaning solution and the debris from the carpet through the vacuum hose to form, in combination with the base unit, a wet carpet cleaner.

12 Claims, 12 Drawing Figures

COMBINED DRY AND WET CARPET CLEANER

The present invention relates to carpet cleaners, and more particularly, to carpet cleaners which are useable in a dry or a wet mode.

In the field of carpet cleaning, vacuum carpet cleaners of various types have existed for a number of years. Generally, these carpet cleaners include a transportable unit housing a motor and impeller for creating a low pressure source or vacuum. Directly or through conduits, the vacuum is in fluid communication with a rigid or collapsible housing containing an air porous bag. The opening of the bag is in fluid communication with a vacuum hose extending from a vacuum head. In operation, the vacuum or low pressure environment within the vacuum head tends to draw from the carpet or other surface being cleaned dislodgeable particulate matter. Thus, conventional vacuum carpet cleaners are used primarily for the removal of loose particulate matter. To clean carpets thoroughly, a wet carpet cleaner is generally employed. The following U.S. Patents, assigned to the present assignee, describe various embodiments of such carpet cleaners: U.S. Pat. Nos. 3,959,844; 4,019,218; 4,136,420; Des. 239,810; Des. 239,811 and Ser. No. 839,301, soon to be U.S. Pat. No. 4,156,952. Within the pertinent art, these wet carpet cleaners are generally referred to as soil extractors and they operate in the manner described below.

A U.S. Pat. No. 4,138,761, recently issued to Nauta, describes a composite wet or dry carpet cleaner having a source of vacuum mounted integral with a vacuum container, which container is removably supported upon a wheeled base; the base serves only as a pedestal for transporting the container across a carpet.

A cleaning solution is dispensed from a vacuum head through nozzles. This cleaning solution, through chemical reaction and the impact force, tends to dislodge film and debris which is not readily detachable from the surface being cleaned. Usually, a brush of some sort is simultaneously actuated to perform a scrubbing action. The snout of the vacuum head, creating a vacuum or low pressure environment, draws up the cleaning solution along with any debris to leave the carpet clean and nearly dry. The relative high cost of carpet soil extractors and the infrequency of use by private individuals in homes render them of commercial importance primarily only to commercial facilities and to commercial carpet cleaners who clean carpets for a price.

It is therefore a primary object of the present invention to provide a carpet cleaning unit which is readily convertible from a vacuum cleaner to a soil extractor.

Another object of the present invention is to provide a carpet cleaner having a base unit useable with detachably attachable modules to convert the carpet cleaner from a vacuum cleaner to a soil extractor.

Still another object of the present invention is to provide a carpet cleaner selectively operable as a vacuum cleaner or soil extractor.

A yet further object of the present invention is to provide a carpet cleaner base unit with attached vacuum hose and vacuum head which base unit will support either a housing for a vacuum bag or one housing containing two compartments for ejecting and collecting a cleaning solution.

A further object of the present invention is to provide a low cost carpet cleaner useable as either a vacuum cleaner or a soil extractor.

A still further object of the present invention is to provide a carpet cleaner having a base unit containing apparatus for developing a vacuum, which vacuum is useable with either vacuum cleaner associated elements or soil extractor associated elements.

A yet further object of the present invention is to provide low cost attachments to a base unit of a carpet cleaner to convert inexpensively the carpet cleaner from a vacuum cleaner to a soil extractor and back.

These and other objects of the present invention will become apparent to those skilled in the art as the description thereof proceeds.

The present invention may be described with greater specificity and clarlity with reference to the following drawings, in which.

Figure 1:
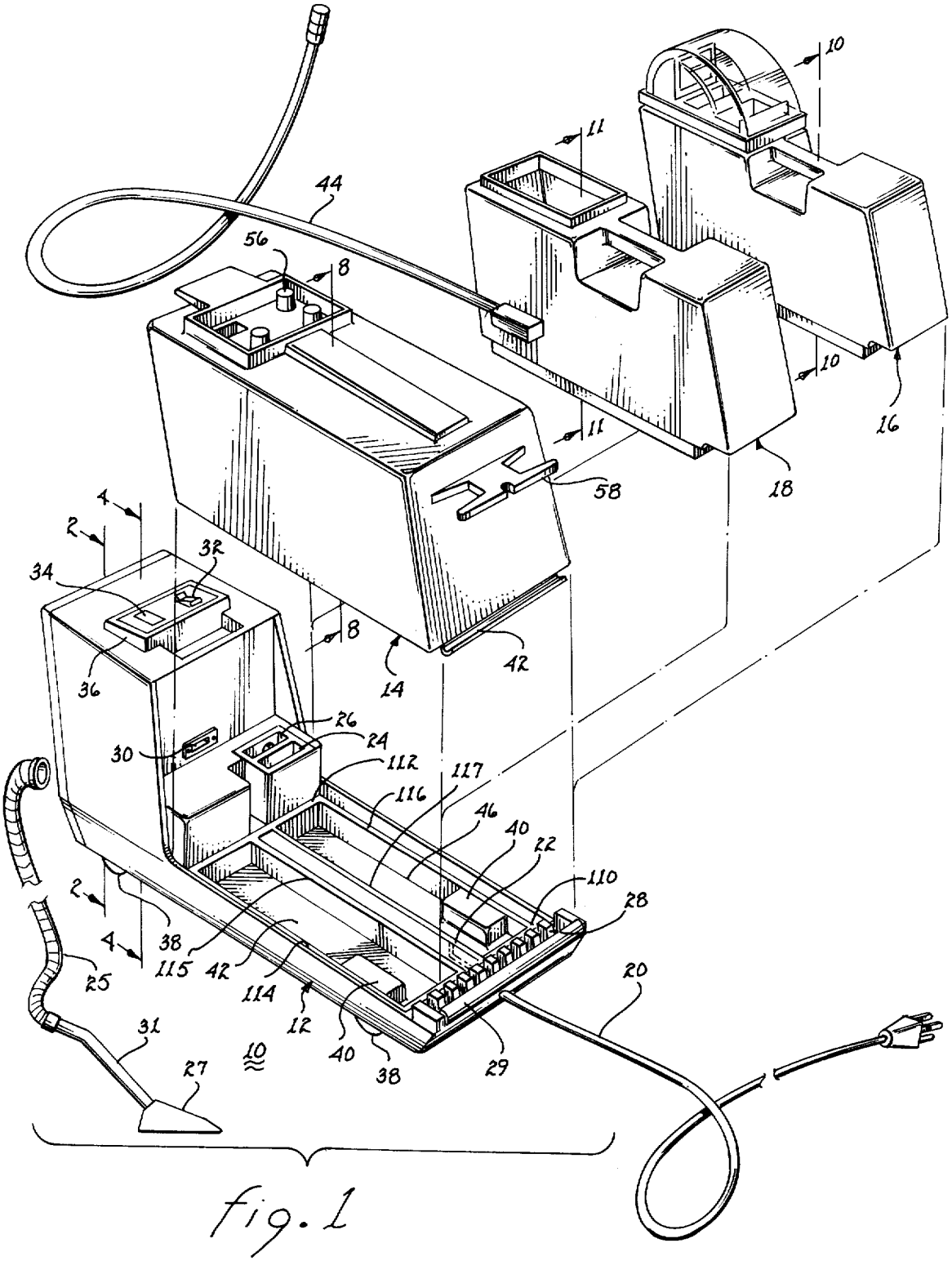
FIG. 1 is an isometric view of the major elements attendant the present invention.
Figure 9:
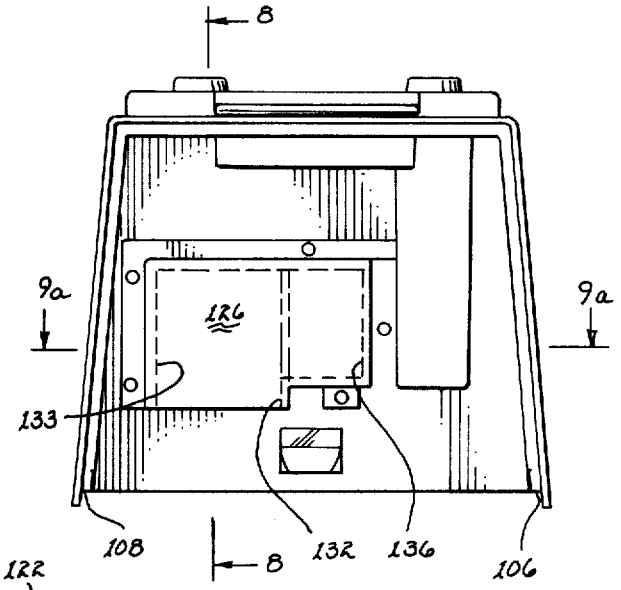
FIG. 9 is an end view taken along lines 9—9, as shown in FIG. 8.
Figure 10:
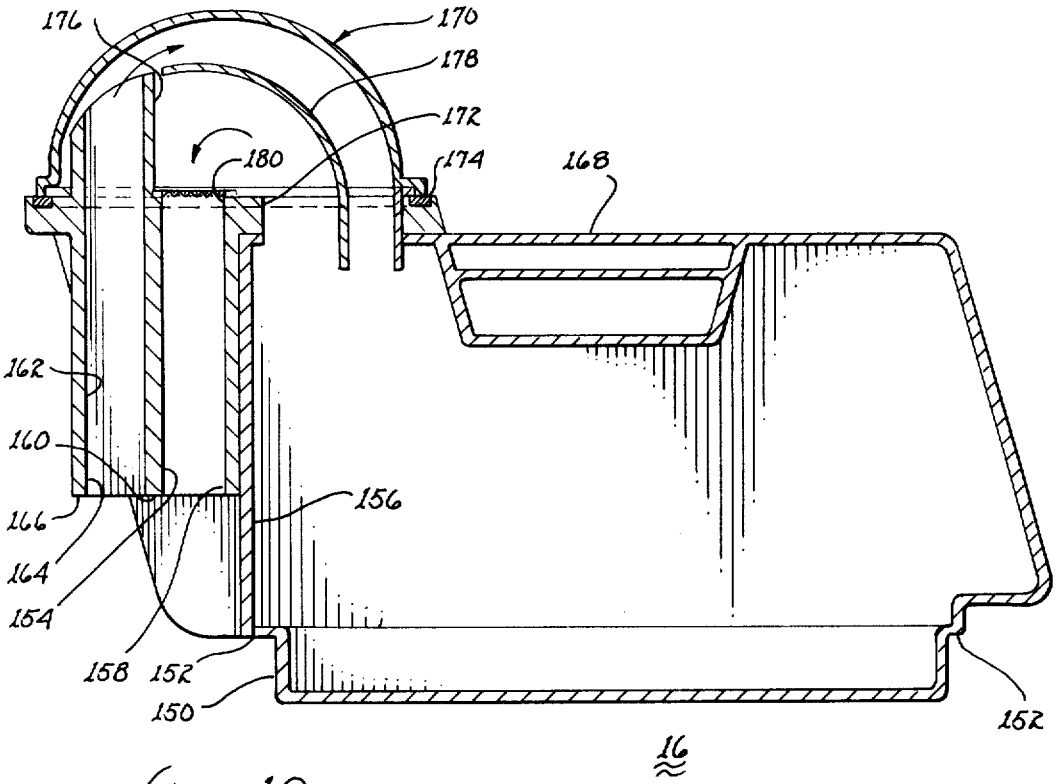
Figure 11:
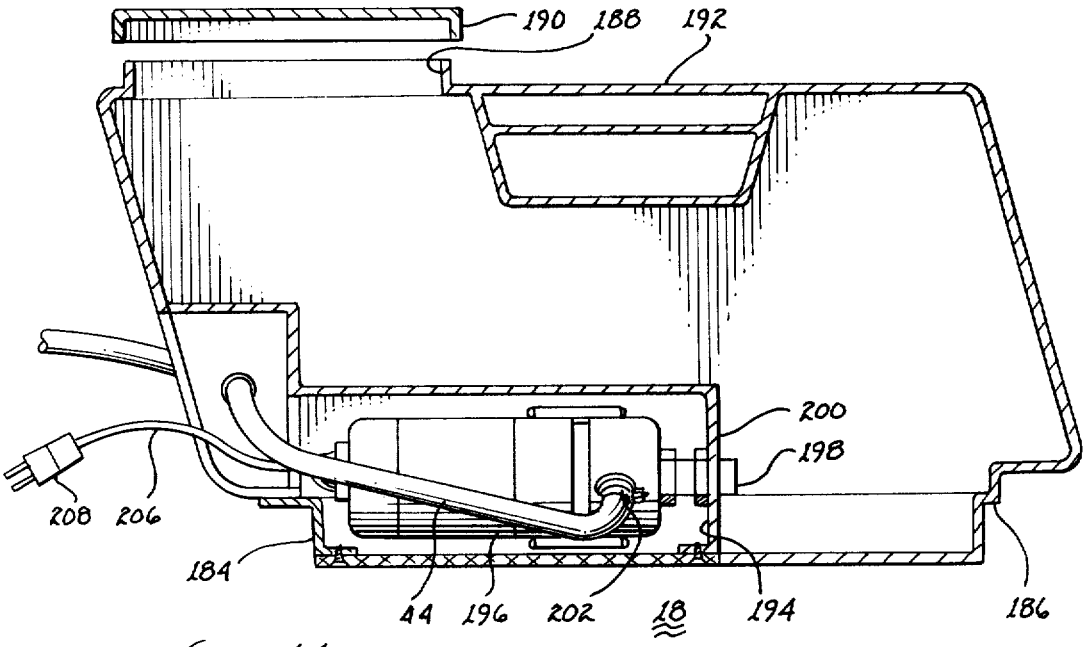

FIG. **9*a* is a partial cross-sectional view taken along lines 9*a*—9*a* as shown in FIG. 9**;

FIG. 10 is a cross-sectional view taken along lines 10—10 as shown in FIG. 1; and FIG. 11 is a cross-sectional view taken along lines 11—11, as shown in FIG. 1.

In the vernacular of those skilled in the art, the term "vacuum" is used to identify a lower than ambient pressure, rather than to indicate a vacuum in the technical sense of the word; accordingly, the term "vacuum" is used herein in the vernacular ot those skilled in the art.

Referring to FIG. 1, there is shown a carpet cleaner 10 having a base unit 12 to which either a housing 14 or a pair of containers 16 and 18 are attachable. The base unit includes an electric motor receiving a source of electrical power through cord 20 to drive an impeller and create a vacuum within each of inlets 22 and 24. Means are also included for establishing fluid communication between an attachable vacuum hose 25 supporting a vacuum head 27 and attached handle 31 with aperture 26. The vacuum hose and/or vacuum head may be any of the types, or variations thereof, shown in the above identified patents or applications therefor identified above and assigned to the present assignee. Various switches 32 and indicator lights 34 may be disposed upon a control panel 36 at the top of base unit 12. The base unit mounted upon a plurality of wheels 38 to accommodate transport across the surface being cleaned. These wheels may be free pivoting or lodged within their individual wheel wells, as indicated by numeral 40.

Housing 14 includes hinge half 42 of hinge 29 to rotatably mate with hinge half 28 at the rear of the base unit 12 and thereby preclude removal of the housing without commensurate rotation about the hinge line. Because of the location of the hinge, the weight of the housing is on one side thereof, which weight will maintain the housing lodged upon the supporting members of the base unit. Inlet 24 is channeled into operative engagement with the interior of housing 14, the edges of which are sealed by corresponding surfaces of the base unit, to develop a vacuum within the housing. A porous air bag is mounted internal to housing 14 and, upon attachment of the housing to base unit 12, is brought into operative engagement with aperture 26 to channel debris recovered by the vacuum head through the vacuum hose into the bag.

Housing 14 may include a plurality of fixtures 56 disposed in the top thereof for receivingly retaining various attachments used in conjunction with the vacuum hose. Additionally, the rear of the housing may include a support 58 which serves as a hand grip to aid in manipulation of the carpet cleaner and as a support for wrapping cord 20 therearound during non-use of the carpet cleaner.

In the configuration of the carpet cleaner described above, the combination of base unit 12 and housing 14, a vacuum carpet cleaner is created.

To transform the carpet cleaner into a soil extractor, housing 14 is replaced by containers 16 and 18, each of which is approximately ½ the width of housing 14 and is lodged in keyed relationship with the respective one of depressions 46 and 42 in the base unit. Container 18 includes a compartment for dispensing cleaning solution, which solution is dispensed by an internally mounted pump receiving electrical power from receptacle 30 in base unit 12 and discharging the cleaning solution through a hose 44. The hose is operatively connected to the vacuum hose and vacuum head and in fluid communication with nozzles disposed in the vacuum head. Thereby, the cleaning solution is forcefully ejected onto a surface being cleaned, such as a carpet. Upon mounting of container 16 in depression 46 in base unit 12, inlet 22 is sealed off by the bottom of container and inlet 24 is in fluid communication with the interior of the container. Additionally, aperture 26 is in fluid communication with the interior of the container. The vacuum developed at inlet 24 produces a commensurate vacuum within the container which vacuum is translated to the attached vacuum head in fluid communication with aperture 26. Thereby, the vacuum will tend to draw the cleaning solution and debris from the carpet being cleaned through the vacuum hose, aperture 26 and into container 16.

In the configuration of the carpet cleaner described above, the combination of base unit 12 and containers 16 and 18, a carpet soil extractor is created.

From the above description, it becomes readily apparent that base unit 12 provides all of the elements common to both vacuum cleaners and soil extractors. Moreover, conversion of the carpet cleaner from a vacuum carpet cleaner to a soil extractor is readily and quickly performable by simply substituting housing 14 with containers 16 and 18 or vice versa. Thus, the carpet cleaner is capable of operating in either mode. It may also be deduced that the ultimate purchaser can purchase either housing 14 or containers 16 and 18 upon purchase of base unit 12 and purchase of the non-elected items may be deferred without additional costs to effect conversion capability.

Figure 2:
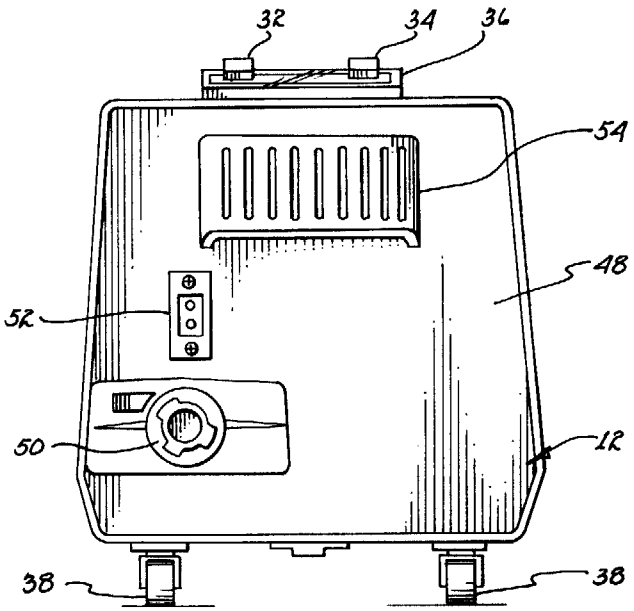
FIG. 2 is an end view taken along lines 2—2, as shown in FIG. 1.

As shown in FIG. 2, front 48 of base unit 12 includes a male or female fitting 50 for engagingly supporting the end of the vacuum hose 25. Directly associated with the fitting or located in proximity thereto is a receptacle 52 for providing electrical power to an electric motor disposed in vacuum head 27 for actuating a scrub brush mechanism in the vacuum head. It is to be understood, that different vacuum heads and scrub brushes may be attached, depending upon the mode of operation of the carpet cleaner. To aid in ease of transport of the carpet cleaner, a hand grip 54 may be diposed on front 48.

Figure 3:
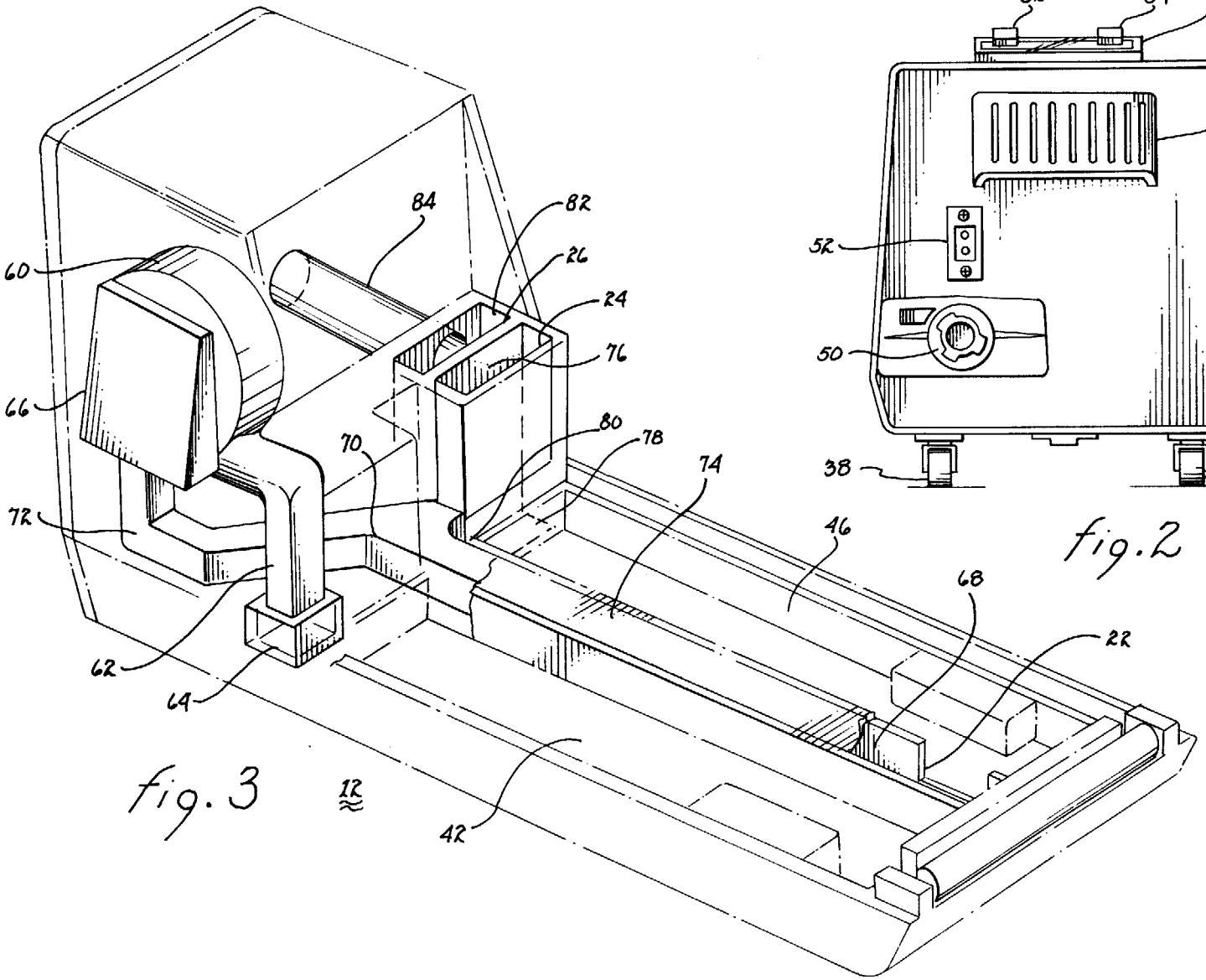
FIG. 3 is a functional diagram illustrating the channeling of the air flow within a base unit of the carpet cleaner.

Referring particularly to FIG. 3, the air flow channeling disposed in base unit 12 will be described. An electric motor driven impeller is disposed within enclosure 60. The impeller creates a flow of exhaust air which is directed into conduit 62 terminating at exhaust port 64 in the bottom of the base unit. The intake to enclosure 60 is commensurate with plenum 66. The plenum is in fluid communication with inlet 22 and inlet 24. A conduit 68 extends from inlet 22 to junction 70 and thence through conduit 72 to plenum 66. It may be noted that conduit 68 defines a central spine 74 dividing depressions 42 and 46 and serves as a structural member to provide rigidity and robustness to base unit 12. Air flow from inlet 24 flows vertically downwardly through passageway 76 terminating at the floor 78 of the base unit. An aperture 80 is disposed in the side of passageway 76 to interconnect the passageway with junction 70. Thereby, air is drawn into plenum 66 from inlets 22 and 24 and is exhausted through exhaust port 64. Clearly, closure of one of inlets 22 or 24 limits the inflow of air through the remaining inlet.

All air, debris and/or fluids drawn up from the carpet being cleaned by the vacuum head are introduced into base unit 12 through fitting 50 (see FIG. 2). This fitting is in fluid communication with chamber 82 by conduit 84 extending from the fitting. The inflow to chamber 82 is exhausted therefrom through aperture 26.

Figure 4:
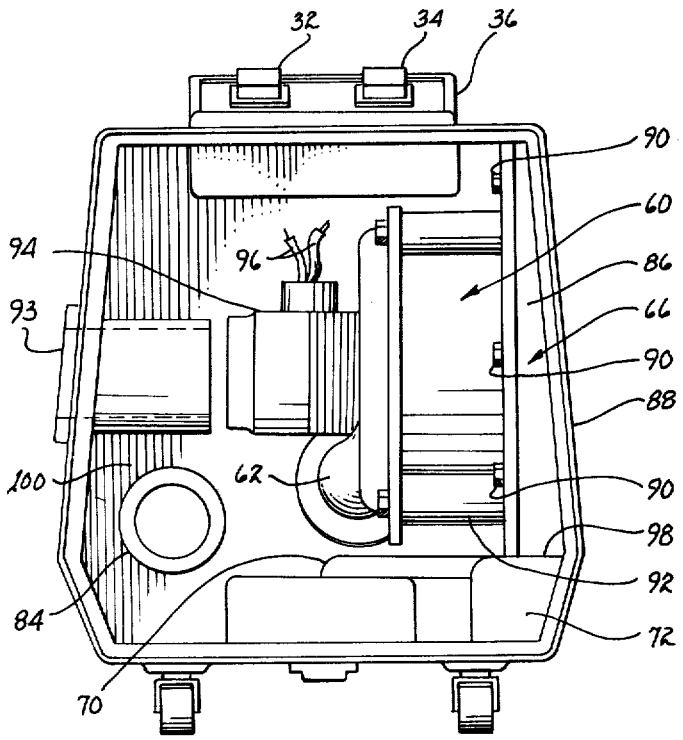
FIG. 4 is a cross-sectional view taken along lines 4—4, as shown in FIG. 1.

The arrangement of components within the upright portion of base unit 12 will be described with particular reference to FIG. 4. Plenum 66 is developed with a shroud 86 attached to and extending from side wall 88 of the upright portion of the base unit. Enclosure 60 is secured to shroud 86 by attachment means, such as screws or bolts 90. Enclosure 60 includes an essentially cylindrical housing 92 for enveloping an impeller. Drive motor 94 for the impeller is secured to and supported by housing 92 and cooling air therefor is obtained through duct 91 and screen 93. Electrical conductors 96 extend from the motor and interconnect through switch 32 with cord 20. Exhaust conduit 62 extends from the cylindrical surface of housing 92 rearwardly therefrom and terminates at an exhaust port at the bottom of the base unit (as shown in FIG. 3).

Opening 98 to plenum 66 establishes fluid communication with conduit 72. Conduit 72 is developed by horizontal and vertical bulkheads defining a passageway extending rearwardly from the plenum to junction 70. The vertical and horizontal bulkheads serve not only to define the conduit, in combination with the floor and sides of the base unit, but also serve as structural members adding rigidity and strength to the base unit. Conduit 84, extends rearwardly from the front face of the upright portion to a vertical bulkhead 100 defining the rear wall of the upright portion and thereby serves a dual function of conveying the inflowing mixture and as a structural element to add rigidity and strength to the upright portion. The remaining space within the upright portion may be used to accommodate various plugs, switches and terminal boards required for safety and maintenance purposes.

Referring jointly to FIGS. 5, 6, 7, 8, 9 and 9*a*, the operational cooperative relationship between base unit 12 and housing 14 will be described. On attachment of housing 14 to base unit 12 by engaging the halves of hinge 29, supporting edges 102, 104, 106 and 108 rest upon shoulders 110, 112, 114 and 116, respectively, in the base portion of the base unit. Seal means, such as foam tape, may be disposed upon the shoulders to ensure a reasonably air tight seal around the bottom edges of the housing. It may be noted that the bottom of housing 14 is open to provide access for insertion and removal of air bag 118. Additionally, inlet 22 is not closed off whereby a vacuum present at the inlet will, due to the seal around the bottom edges of the housing, create a vacuum within the housing.

The air bag is secured to a hollow stud 120 extending interiorly from wall 122 of the housing; the means for securing the air bag to the stud may be by a rubber band 124 or similar well known means. A compartment 126 is attached to and extends forwardly of wall 122. This compartment includes a side wall 128 of a size and shape to extend across inlet 24 and rest upon the edges defining the inlet. Seal means 130 may be disposed upon these edges to effect an air tight seal of the inlet. The forward bottom portion of compartment 126 defines an aperture 132 commensurate in configuration with underlying aperture 26. Further seal means 131 may be disposed about aperture 26 to bear against the adjacent surface of compartment 126 to effect a seal between the edges of aperture 132 and aperture 26. Aperture 132 opens into a chamber 133, which chamber is connected to chamber 136 through opening 138. Chamber 136 is in fluid communication with the interior of stud 120. The sideward channeling of the air flow places stud 120 at the approximate center of the housing.

The operation of the above described embodiment of carpet cleaner 10 may be described as follows. On actuation of motor 94, a vacuum will be present within conduit 68 and passageway 76. As inlet 24 is sealed no airflow through passageway 76 will occur and the air drawn into plenum 66 must come from inlet 22 through passageway 68. The vacuum present at inlet 22 creates a vacuum within housing 14. The vacuum within housing 14 causes a mixture of air and debris to flow from vacuum head 27 through attached vacuum hose 25 into conduit 84, chamber 82, chambers 133 and 136 of compartment 126, hollow stud 120 and into air bag 118. As the air bag is air porous, it will filter the air flow to retain any recovered debris and yet allow the air to flow therethrough into inlet 22. The air exhausted by the impeller flows through exhaust port 64 in the bottom of the base unit.

To aid attachment and detachment of housing 14 by pivoting it about hinge 29, a forward facing hand hold 134 may be disposed at the forward top of the housing. On pivoting the housing upwardly and rearwardly the bag will be reoriented to encourage debris within the bag to drop to the bottom of the bag and thereby facilitate removal of the bag from about stud 120.

Figure 9A:
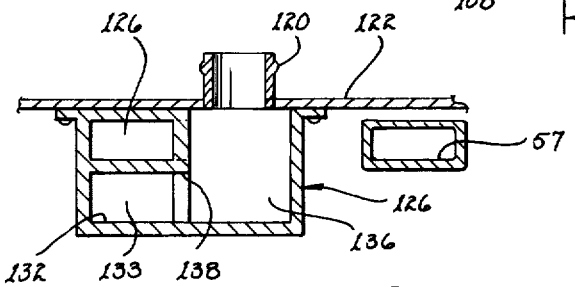

As particularly depicted in FIGS. 9 and 9*a*, fittings 56 may include a recess 57 for receiving and storing a special purpose elongated attachment to the vacuum hose.

The soil extractor embodiment of the present invention will be described with particular reference to FIGS. 1, 3, 10 and 11. Container 16 includes a bottom 150 generally commensurate in length, width and depth with depression 46 in the base portion of base unit 12. A shoulder 152 extends about bottom 150 lateral thereto to sealingly mate with shoulders 110, 112, 116 and 117 of the base unit. Bottom 150 impinges upon and at least partially covers inlet 22 to at least reduce an air flow therethrough. To ensure that little if any air flow therethrough occurs, seal means, such as strips of foam tape may be disposed intermediate the shoulder circumscribing depression 46 and shoulder 152 of container 160; thereby, inlet 22 will not be in communication with ambient air.

Figure 5:
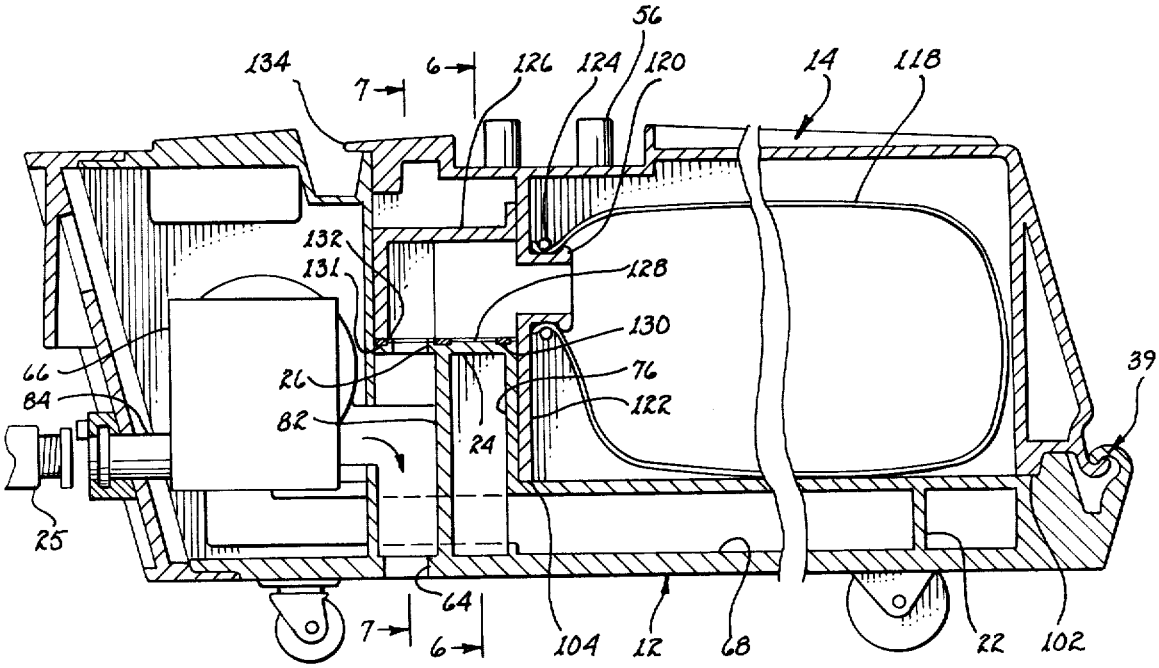
FIG. 5 is a cross-sectional view of the carpet cleaner in a vacuum mode.
Figure 7:
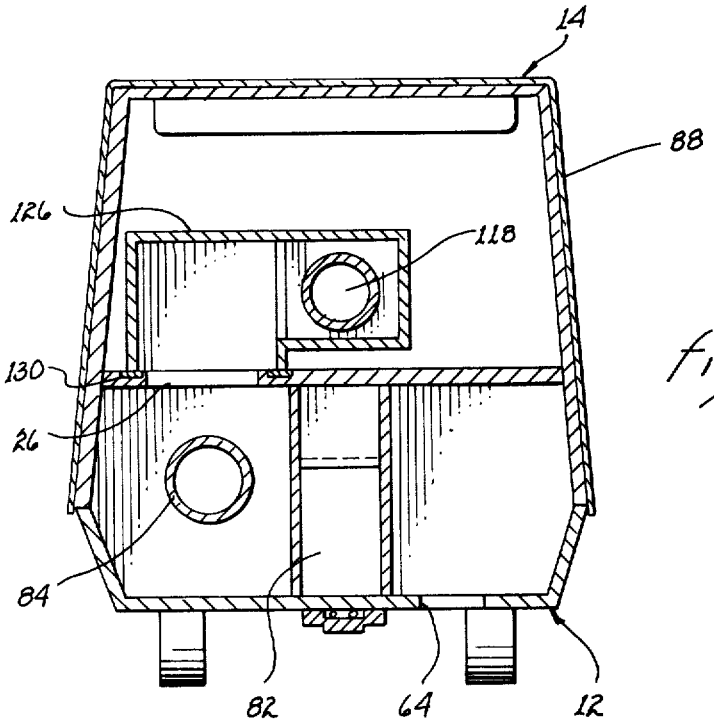
FIG. 7 is a cross-sectional view taken along lines 7—7, as shown in FIG. 5.
Figure 6:
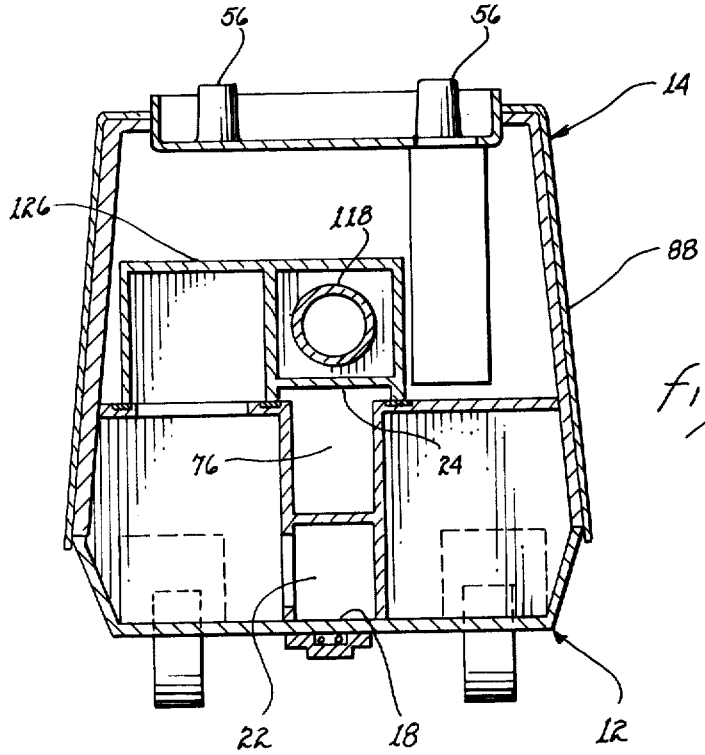
FIG. 6 is a cross-sectional view taken along lines 6—6, as shown in FIG. 5.
Figure 8:
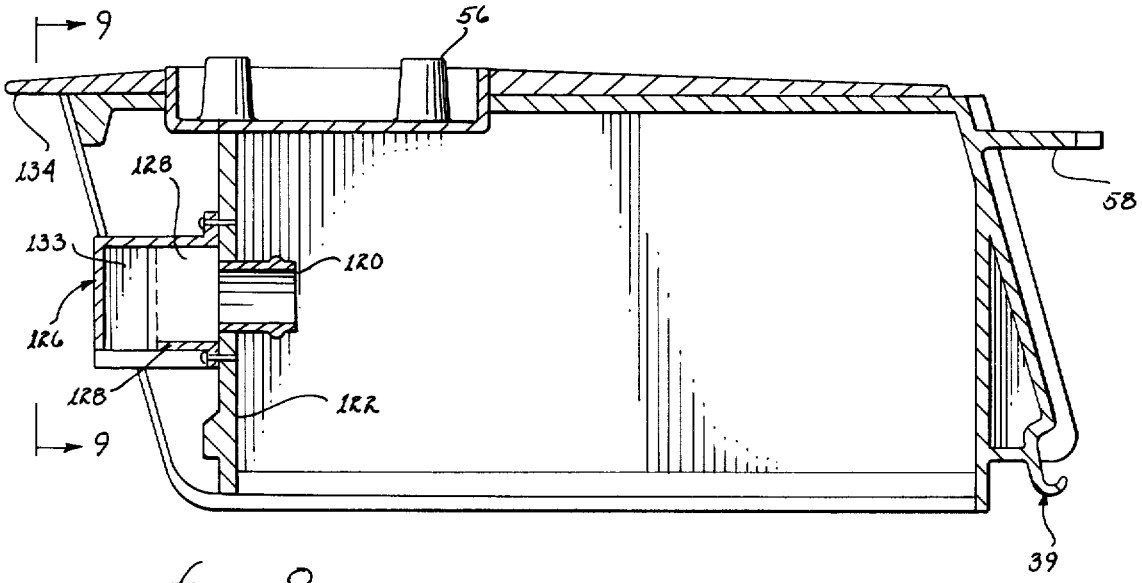
FIG. 8 is a cross-sectional view taken along lines 8—8, as shown in FIG. 1.

A tubular passageway 154 is mounted to forward wall 156 of container 16. Opening 158 and surrounding edge 160 of the passageway are dimensioned to mate with inlet 24 and the edges defining the inlet. As illustrated in FIG. 5, seal means 130 may be employed to insure an air tight interconnection between passageway 154 and passageway 76. A second tubular passageway 162 is disposed forwardly of passageway 154. The lower extremity of passageway 162 terminates in opening 164 defined by lower edges 166. Opening 164 and the circumscribing edges are dimensionally commensurate with aperture 26 and the upper edges of cavity 82. Again, seal means 132 (see FIG. 5) may be employed to ensure an air tight interconnection between the two passageways.

A removable semi-circular shroud 170 extends across the upper ends of passageways 162 and 154 and inlet 172 to container 16. Sealing means 174 may be employed intermediate shroud 170 and the supporting surface of the container to effect an air tight seal. A tubular extension 176 may extend upwardly into shroud 170 to channel the mixture flowing through passageway 162 into the space defined by the shroud. The shroud itself may include a deflector 178 positionally commensurate with the rear edge of extension 176 to deflect the mixture above and past inlet 180 of passageway 154 and through inlet 172 into container 16.

Container 16 may include an attached or, as illustrated, an integral handle 168 to aid in attachment and detachment of the container with the base unit.

In operation, a vacuum is developed at inlet 24 due to the sealing of inlet 22 and resulting from actuation of the impeller within housing 60. This vacuum is translated through passageway 154 into container 16. Vacuum within container 16 will create a low pressure environment in passageway 162 and chamber 82 to draw a mixture of cleaning solution through vacuum head 27, vacuum hose 25, conduit 84, chamber 82 and passageway 62. The force of the cleaning solution and debris flowing upwardly through passageway 162 will cause it to flow through extension 176 and strike the inner surface of shroud 170 and be deflected. Thereby, the cleaning solution and debris is directed through opening 172 into the container where it will be corrected. Deflector 178 precludes entrance of the cleaning solution and debris into passageway 154 through inlet 180.

Dispensation of the cleaning solution to the vacuum head is performed by container 18 and the mechanism associated therewith. Container 18 includes a bottom 184 of a width, length and depth generally commensurate with depression 42 in the base portion of base unit 12. A shoulder 186 extends about bottom 184 and rests upon shoulders 110, 112, 114 and 115 circumscribing depression 42. The container includes an inlet 188 for pouring cleaning solution into the container; a cap or cover 190 may be employed to prevent spillage of cleaning solution on transport of the container. To ease in transporting the container, a handle 192 may be integral with the container, as shown or it may be a separately attached handle.

A compartment 194 is formed at the bottom of the container to house a motor and pump assembly 196. Intake 198 to the pump extends through wall 200 of compartment 194 to place the inlet in proximity to the bottom of the container. Outlet 202 of the pump is connected to a house 44, which hose is ultimately attached to vacuum head 27 for discha-ge of the cleaning solution through nozzles in the vacuum head. Electrical power for the motor pump assembly is provided through cord 206 and plug 208, which plug mates with receptacle 30 in the upright portion of the base unit.

In operation, container 18 houses cleaning solution to be ejected when carpet cleaner 10 operates in the soil extractor mode. On energization of motor pump assembly 196, the cleaning solution will be picked up by screened inlet 198 internal to the container and conveyed under pressure through hose 204 for ultimate discharge through the nozzles in the vacuum head. Actuation or energization of the motor pump assembly may be effected automatically on energization of vacuum motor 94 or it may be selectively energized by other switch means.

From the above description, it will become readily apparent that both containers 16 and 18 are readily placed upon and removed from base unit 12 by simply lifting the containers by their respective handles. Moreover, the size of the containers may be limited to a few gallons where carpet cleaner 10 is to be used primarily in the home or the containers may be substantially larger for use by commercial carpet cleaners or at industrial locations. With the present invention, the user can simply and readily lift the containers off the base unit and transport them to a larger dump container or sink for emptying the waste water and container 18 can be filled at a remote location independent of transport of the base unit to the remote location. This savings in time, effort and convenience is of substantial importance to both retail users and commercial operators.

It is to be understood that a single container, housing both the cleaning solution to be dispensed and the mixture of cleaning solution and debris to be collected may be employed. Segregation between these fluids might be effected by means such as a flexible or expandable membrane.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A dual function carpet cleaner for dry and wet cleaning of a carpet, said carpet cleaner comprising in combination:

(a) a base unit for supporting either of two interchangeable debris collecting containers, one of said containers being used with said base unit for dry cleaning and another of said containers being used with said base unit for wet cleaning, said base unit including:

i. a source of vacuum for establishing an air flow;

ii. an inlet in fluid communication with said source of vacuum and ambient air for establishing an air flow path to said source of vacuum;

iii. a vacuum hose and attached vacuum head connectable to said base unit for receiving and channeling debris into said base unit; and iv. an outlet in fluid communication with said vacuum hose for discharging any debris received by and channeled through said vacuum hose;

(b) said one container comprising:

i. an housing in fluid communication with and disposed intermediate said inlet and said outlet for conveying air flow from said outlet through said housing and into said inlet in response to said source of vacuum;

ii. a filter disposed within said housing, said filter being in interfering relationship with the air flow through said housing for filtering debris from the air flowing from said vacuum hose, through said outlet and into said housing;

(c) said other container comprising:

i. a first container for containing a cleaning solution to be discharged onto the carpet being cleaned;

ii. a second container in fluid communication with and disposed intermediate said inlet and said outlet for collecting a mixture of cleaning solution and debris drawn through said outlet into said second container in response to the air flow to said source of vacuum through said inlet from said vacuum hose in fluid communication with said outlet;

whereby, said base unit is useable with either said one or said other of said interchangeable containers to dry or wet clean, respectively, a carpet.

2. The carpet cleaner as set forth in claim 1 wherein said vacuum head includes means for spraying the cleaning solution upon the carpet.

3. The carpet cleaner as set forth in claim 1 wherein said base unit includes a base portion for supporting either of said interchangeable containers.

4. The carpet cleaner as set forth in claim 3 wherein said housing includes a hollow stud in fluid communication with said outlet and said filter comprises an air porous bag attachable to said stud.

5. The carpet cleaner as set forth in claim 4 wherein said housing includes an opening for access to and replacement of said filter.

6. The carpet cleaner as set forth in claim 5 wherein said base portion includes a seal for sealing said opening on placement of said housing upon said base portion.

7. The carpet cleaner as set forth in claim 6 wherein said second container includes a first opening, said first opening being engageable in fluid communication with said inlet and a second opening, said second opening being engageable in fluid communication with said outlet, with engagement occurs on mounting of said second container upon said base portion.

8. The carpet cleaner as set forth in claim 7 wherein said inlet includes a first inlet disposed in said base portion, said first inlet being engageable in fluid communication with said opening of said housing on mounting of said housing upon said base portion and a second inlet disposed in another part of said base unit, said second inlet being engageable in fluid communication with said first opening in said second container on mounting of said second container upon said base portion in place of said housing, said housing including a wall for closing said second inlet on mounting of said housing upon said base portion and said second container including a wall for closing said first inlet on mounting of said second container upon said base portion, said housing and said second container each including means for sealing said first and second inlets, respectively.

9. The carpet cleaner as set forth in claim 8 wherein said second container includes a shroud for separating the flows attendant said first and second openings.

10. The carpet cleaner as set forth in claim 9 wherein said second container includes an aperture for emptying the mixture of collected cleaning solution and debris and a cover for sealing said aperture.

11. The carpet cleaner as set forth in claim 10 wherein said shroud includes said cover.

12. The carpet cleaner as set forth in claim 8 wherein said first container includes a pump for evacuating the cleaning solution from said first continer.

* * * * *